US006009930A

United States Patent [19]

Jantschek

[11] Patent Number: 6,009,930

[45] Date of Patent: Jan. 4, 2000

[54] PORTABLE WALL PARTITION WITH FULL PANEL END MEMBERS

[75] Inventor: Robert J. Jantschek, Stillwater, Minn.

[73] Assignee: Versare Solutions, Inc., Minneapolis, Minn.

[21] Appl. No.: 09/289,708

[22] Filed: Apr. 12, 1999

Related U.S. Application Data

[63] Continuation-in-part of application No. 09/092,121, Jun. 5, 1998, abandoned.

[51] Int. Cl.[7] ..... A47G 5/00

[52] U.S. Cl. ..... 160/135; 160/352

[58] Field of Search ..... 160/135, 351, 160/229.1, 352; 52/238.1, 239; 40/605, 606, 610

[56] References Cited

U.S. PATENT DOCUMENTS

| | | |
|---|---|---|
| D. 323,944 | 2/1992 | Maas . |
| D. 330,646 | 11/1992 | Maas . |
| D. 345,018 | 3/1994 | Maas . |
| 668,748 | 2/1901 | Buhcanan . |
| 756,091 | 3/1904 | Altick . |
| 1,410,225 | 3/1922 | Seaman . |
| 1,659,928 | 2/1928 | Townsend . |
| 1,731,327 | 10/1929 | Terrisse . |
| 2,072,028 | 2/1937 | Cooper . |
| 2,162,523 | 6/1939 | Blood et al. . |
| 2,682,722 | 7/1954 | Waller et al. . |
| 3,017,969 | 1/1962 | Nielsen . |
| 3,060,521 | 10/1962 | Greco . |
| 3,232,370 | 2/1966 | Jaffe . |
| 3,330,611 | 7/1967 | Heifetz . |
| 3,387,413 | 6/1968 | Huey . |
| 3,402,515 | 9/1968 | Rainaut . |
| 3,534,512 | 10/1970 | Ballas . |
| 3,565,152 | 2/1971 | Cohn . |
| 3,629,982 | 12/1971 | Ballay . |
| 3,674,081 | 7/1972 | List . |
| 3,677,322 | 7/1972 | Brorson et al. . |
| 3,866,365 | 2/1975 | Honigman . |
| 4,056,985 | 11/1977 | Worrallo . |
| 4,161,850 | 7/1979 | Peterson et al. . |
| 4,192,106 | 3/1980 | Hell . |
| 4,443,911 | 4/1984 | Bannister . |
| 4,444,240 | 4/1984 | Bannister . |
| 4,448,231 | 5/1984 | Salkeld et al. . |
| 4,569,163 | 2/1986 | Long . |
| 4,606,394 | 8/1986 | Bannister . |

(List continued on next page.)

FOREIGN PATENT DOCUMENTS

| | | |
|---|---|---|
| 420320 | 11/1934 | United Kingdom . |
| 498323 | 1/1939 | United Kingdom . |

OTHER PUBLICATIONS

1997 Fall Edition of "Outwater Plastics Industries Plastics Division, Architectural Division".

Brochure entitled "Screenflex—Portable Partition Systems", pp. 1–16.

*Primary Examiner*—David M. Purol

*Attorney, Agent, or Firm*—Gerald E. Helget; Mackall, Crounse & Moore, PLC

[57] ABSTRACT

A portable wall partition having a three point pivoting 360° articulate pinch less hinge connecting two panels which may pivot 360° with respect to each other. The hinge has two opposing couplers, each having a toothed semicircular portion meshed with the opposing coupler toothed semicircular portion. Each coupler is adapted to be connected to one of the panels to be pivoted with respect to each other. A pin is in each coupler extending along an axis of the semicircular portion thereof. A link connects each pin to maintain the meshed engagement of the couplers through 360° of coupler pivotal rotation with respect to each other. The link has a sufficient width substantially that of the width of the coupler body as to block and prevent the meshed semicircular portions from pinching an individual's finger or object. The portable wall partition has two full panel end memberwhich provide support, rigidity, privacy, and noise reduction.

21 Claims, 7 Drawing Sheets s

U.S. PATENT DOCUMENTS 4,802,467 2/1989 Pansiera .
4,916,926 4/1990 Shieh .
4,932,172 6/1990 Maas .
4,995,144 2/1991 Gateley .
5,214,885 6/1993 Maas et al. .
5,272,848 12/1993 Maas .
5,537,766 7/1996 Nickens et al. .
5,570,971 11/1996 Rixen et al. .

PORTABLE WALL PARTITION WITH FULL PANEL END MEMBERS

This is a continuation-in-part of previously filed, U.S. patent application Ser. No. 09/092,121, filed Jun. 5, 1998 now abandoned.

BACKGROUND OF THE INVENTION

This invention relates to a portable wall partition with a hinge, and more particularly, to a portable wall partitions three point pivoting 360° articulate pinch less hinges.

There are times when it is desired to divide large areas, such as rooms or halls, into smaller more private areas. One method of doing this is by the use of movable wall panels which are suspended from and move on tracks attached to the ceiling and/or floor. This method is relatively expensive and is inflexible.

Another method of dividing large areas into smaller private areas is to use movable free standing wall units. This method is relatively inexpensive and it permits the formation of areas of a wide variety of shapes, but the free standing wall units present storage and handling problems and do not allow complete flexibility in the placement of the wall units relative to obstructions such as walls and support posts.

Hinges are well known for connecting members that are to rotate or pivot with respect to each other. One of the members may or may not be stationary. Examples of members that pivot with respect to each other are wall panels and room partitions. Examples where one member stays stationary include doors, gates, lids and covers. The most commonly known hinge is commonly referred to as the piano hinge. The piano hinge may generally be described as having flat or plate portions to be secured along the edges of the respective two members that arc to be pivoted with respect to each other. The edges of the hinge plates have fingers or tabs that are formed arcuately into a complete loop portion for capturing a pin or rod. The tabs extending from opposing plates are staggered to permit them to interleave and become aligned with opposing tabs. The aligned looped tabs permit the pin or rod to be captured by the tabs and permit the hinge plates to pivot or rotate with respect to each other.

This type of hinge has two significant drawbacks. Firstly, this hinge structure typically does not permit 360° articulation with respect to the two members but most commonly 180°. Secondly, piano hinges align the edges of the members closely together and, as a consequence, renders the piano style hinge prone to pinching fingers or other objects that happen to get placed in the vicinity of the hinge during such pivotal movement. This is largely because both hinge plate portions arc close together and both pivot about a single axis.

FIGS. 1 through 3 show the significant limitations of the prior art hinges. The hinges 6 are connected to wall panels or room partition members 5. Their articulation limitation, typically 180°, requires that the hinges be alternatively arranged as to permit every other panel to alternately rotate in the other direction. This limitation is required to obtain articulation of the panel assembly. Double headed Arrows A and A' generally show the 180° range of articulation of the panels in opposite direction of each other.

The limitation of this type of hinge structure is shown in FIG. 2. Corners 7 and objects, such as building support columns 8, are difficult to articulate the panels 5 with hinges 6 therearound in any type of aesthetically pleasing manner. FIG. 3 shows how every other hinge 6 is restricted beyond their 180° arc of articulation thereby failing to make a perfectly arcuate or serpentine wall arrangement but rather a cornered wall arrangement B.

There is a need for portable wall partition with a three point pivoting 360° articulable pinchless hinge that is pinch proof, smooth in operation, positive in its movement and will give the user a full range of choices in positioning of the respective members to be hinged together.

SUMMARY OF THE INVENTION

A portable wall partition is disclosed which consists of a number of panels connected by three point pivoting 360° articulable pinchless hinges. The hinge has two opposing couplers, each having a toothed semicircular portion meshed with the opposing coupler toothed semicircular portion. Each coupler is adapted to be connected to one of the panels to be pivoted with respect to each other. A pin is in each coupler extending along an axis of the semicircular portion thereof. A link connects each pin to maintain the meshed engagement of the couplers through 360° of coupler pivotal rotation with respect to each other. The link has a width substantially that of the width of the coupler body as to block and prevent the meshed semicircular portions from pinching an individual's finger or object.

A principal object and advantage of the present invention is that the hinge permits 360° of smooth articulation for the respective panels which are pivotally connected whether both panels are to be articulable or one panel to be stationary.

Another object and advantage of the present invention is that the hinge has three points of pivoting to make the motion smooth and to space the panels apart to prevent pinching.

Another object and advantage of the present invention is that the smooth and positive operations geared meshed arrangement of the hinge readily permits the hinge to support and hold the panels in the position to which they are rotated to.

Another object and advantage of the present invention is that wall panels or room dividers with the present hinge can be positioned to create perfectly arcuate and serpentine wall structures with the full range of 360° movement of each hinge.

Another object and advantage of the present invention is that significant forces exerted on panels connected with the present hinge will not result in tip overs but rather the forces will readily be conveyed from panel member to panel member by the smooth and positive action of the hinges of the present invention.

Another object and advantage of the present invention is that the two full panel end members attached substantially perpendicular at the ends of the portable partition prevent the partition from tipping over.

Another object and advantage of the present invention is that the full panel construction of the two end members, with a solid core and fabric covering, assist in both privacy and noise reduction.

Another object and advantage of the present invention is that the full panel construction of the two end members allows several portable wall partitions to be arranged to form juxtaposed, enclosed areas.

Another object and advantage of the present invention is that the full panel construction of the two end members allows several portable wall partitions to be stored side-by-side with the full panel end members hiding the rest of the portable wall partitions.

Other objects and advantages of the present hinge invention will be apparent upon viewing the figures and reviewing the following specification and claims.

DETAILED SPECIFICATION

Figure 1:
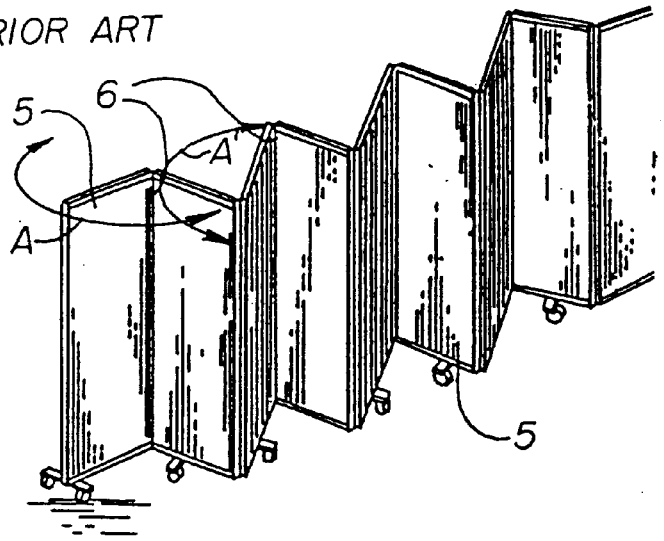
FIG. 1 PRIOR ART
FIG. 1 is a prior art perspective view of room dividers or wall panels commonly connected with piano hinges that fold into an accordion shape.
Figure 2:
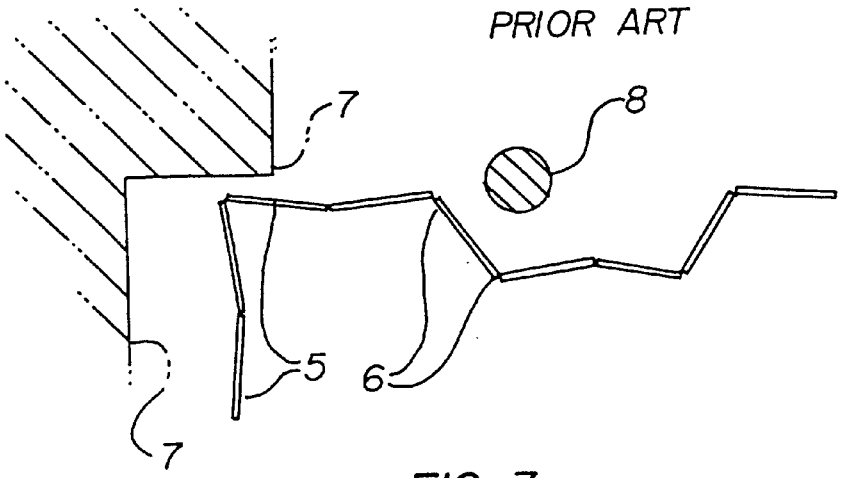
FIG. 2 PRIOR ART
FIG. 2 is a prior art top plan view of the piano hinged room partition panels showing their limitation in movement around objects.
Figure 3:
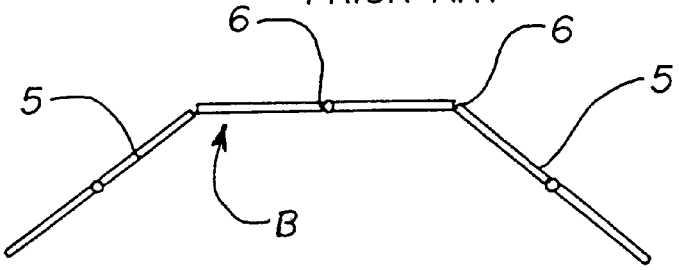
FIG. 3 PRIOR ART
FIG. 3 is a top plan view showing the limited arcuate arrangement of the prior art piano hinges with room dividing panel members.
Figure 4:
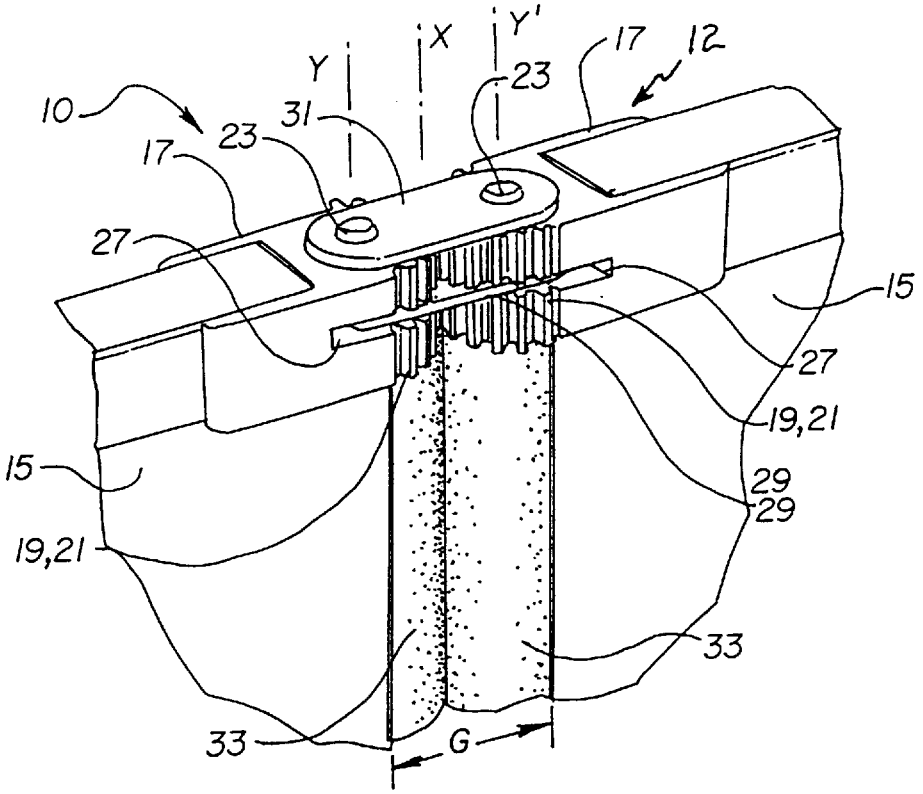
FIG. 4 is a partially broken away perspective view of a portable wall partition with the three point pivoting 360° articulable pinchless hinge of the present invention.
Figure 5:
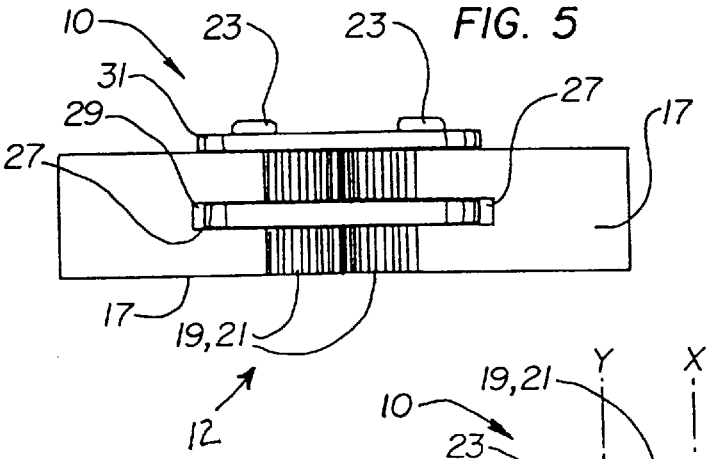
FIG. 5 is a front elevational view, the same as the rear elevational view, of the present hinge.
Figure 6:
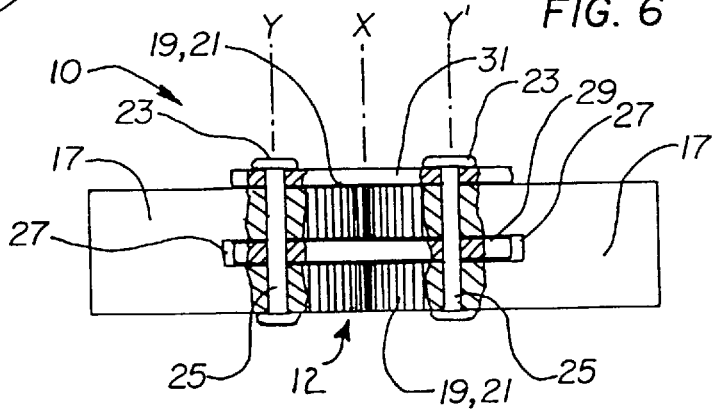
FIG. 6 is a similar view as FIG. 5 with the hinge coupler and link portions broken away for ease of understanding of the pivoting hinge structure.

Referring to FIGS. 4 through 6, the present portable wall partition with 10 three point pivoting 360° articulable pinchless hinge 12 may generally be understood. The hinge 12 generally includes two opposing couplers 17, each having a semicircular portion 19 with teeth 21 meshed to the teeth 21 of the opposing coupler's 17 semicircular portion 19. Couplers 17 are suitably adapted to be connected to panels 15 to be articulated. The connection of the couplers 17 to panels 15 may be by conventional means to include screws, pins, rivets or press fit. Each coupler 17 has a pivot pin 23 extending along an axis Y or Y' of one of the semicircular portions 19. A slot 27 is in each coupler extending transversely of the axes Y or Y' and extends through the semicircular portion 19. A link 29 fits in slot 27 and captures the pivot pins 23.

The links are to be of a width substantially that of the width of the couplers 17. Approximately 80% has been found to be acceptable but lesser or more amounts will also suitably work to avoid pinching.

By this arrangement, a gap G is created by panels 15 as to avoid pinching. Gap G exists because of the three points or axes X, Y and Y' of pivotal movement. That is, the hinge 10 pivots at pins 23 as well as at the meshing point X of the teeth 21 of semicircular portions 19. These three points of pivoting provide a smooth and positive positioning action for the hinge 12. The gap G may be closed by opposing semicircular sponge-like portions 33 as is shown.

FIG. 6 is a partially blown away front elevational view of the hinge 12. The apertures 25 extend through the semicircular portions 19 along axis Y and Y'. Pins 23 may be placed in apertures 25 and have their ends peened over for securing the pins 23 in the apertures 25. Link 29 is placed within the slot 27 and the second link 31 is placed on top of the couplers 17 before the pivot pins 23 have their ends peened over or are otherwise secured in the semicircular portions 19.

Figure 7:
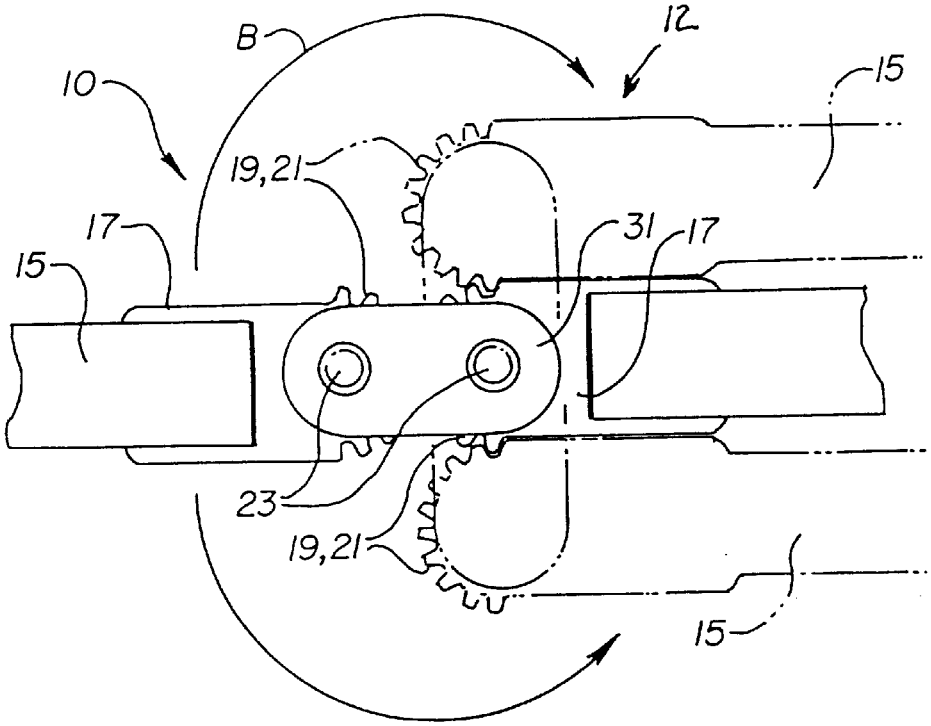
FIG. 7 is a top plan view showing the 360° movement of panels with the hinge with starting and finishing positions in phantom outline.
Figure 8:
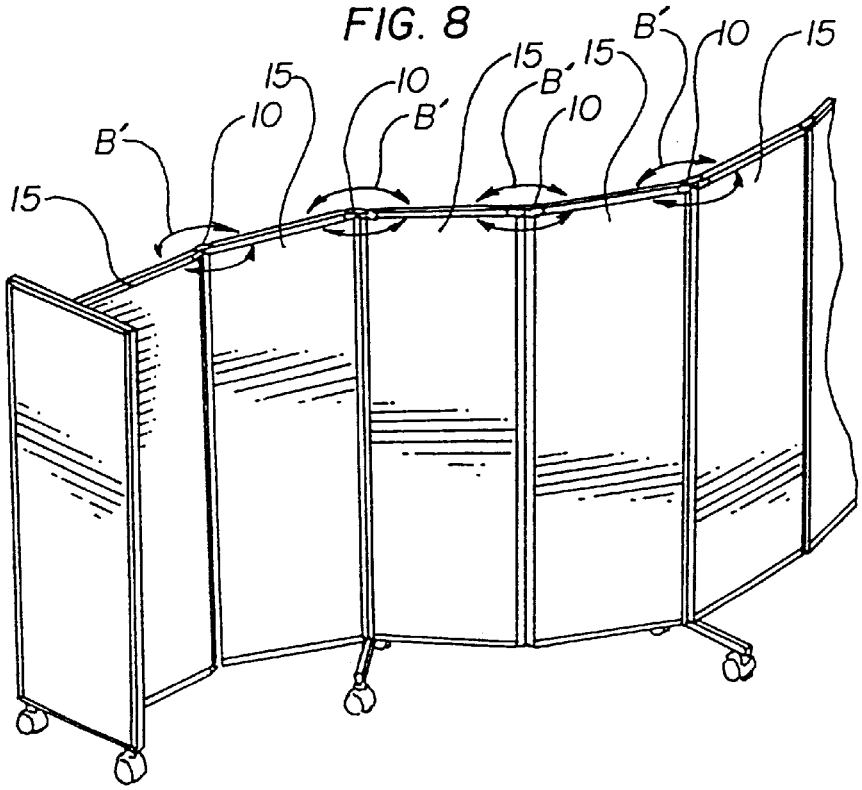
FIG. 8 is a perspective view of the present portable wall partition panels showing the smooth arcuate and serpentine wall panel structure that is available with the present invention.

FIG. 7 shows the articulable pivoting motion of the couplers 17 with respect to each other throughout the 360° of articulable movement (arrows B'). This advantageous movement is further shown in FIG. 8 which permits the panels to have a perfect arcuate or serpentine relationship between members as heretofore not known.

Figure 9:
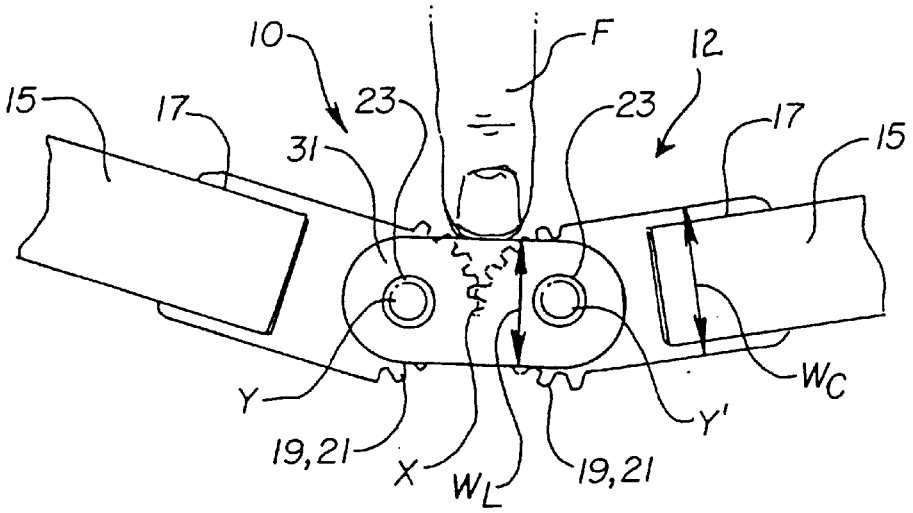
FIG. 9 is a top plan view showing the pinchless nature of the present hinge by way of the substantially wide links.

Referring to FIG. 9, the pinchless quality of the hinge 12 itself may be appreciated. The width $W_L$ of link 29 in relation to the width $W_C$ of the body of coupler 17 is approximately 80% of the width of the coupler 17 to ensure that an individual's finger F cannot be pinched by the meshing teeth 21. Variations up to plus or minus 15% will also suitably prevent pinching to some lesser degree depending upon the size of the finger or obstruction. FIG. 4 illustrates that the gap G is approximately ¾" so as to not pinch fingers. The semicircular sponge portions 33 that oppose each other will simply collapse upon the pinching of a finger F.

Figure 10:
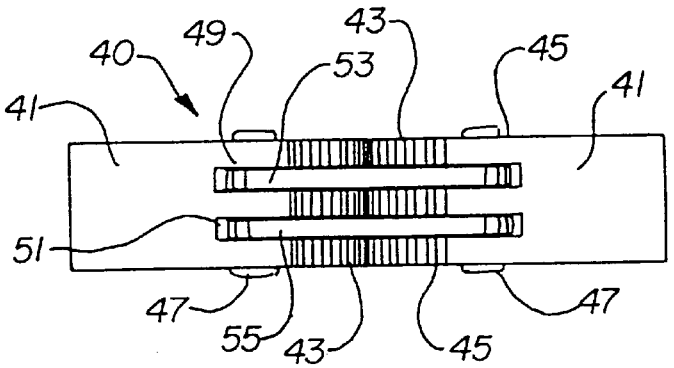
FIG. 10 is a front elevational view, the same as the rear elevational view, of another embodiment of the present hinge.

Referring to FIG. 10, another embodiment of the hinge 40 of the present invention may be seen. Hinge 40 has couplers 41 with semicircular portions 43 with meshed teeth 45. Pivot pins 47 are in each coupler 41 at the axis of each semicircular portion 43. In this arrangement, first slot 49 and second slot 51 are provided for locating first connecting link 53 and second connecting link 55 respectively. This construction offers further protection to prevent an individual's finger F from coming into contact with the meshing teeth 45 to offer a pinchless construction.

Figure 11:
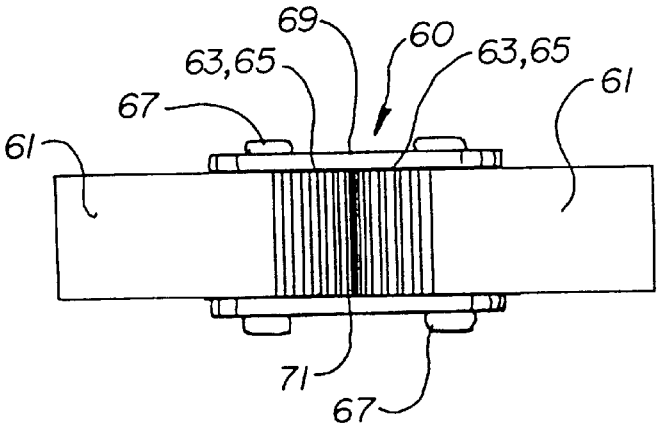
FIG. 11 is a front elevational view, the same as the rear elevational view, of yet another embodiment of the present hinge.
Figure 12:
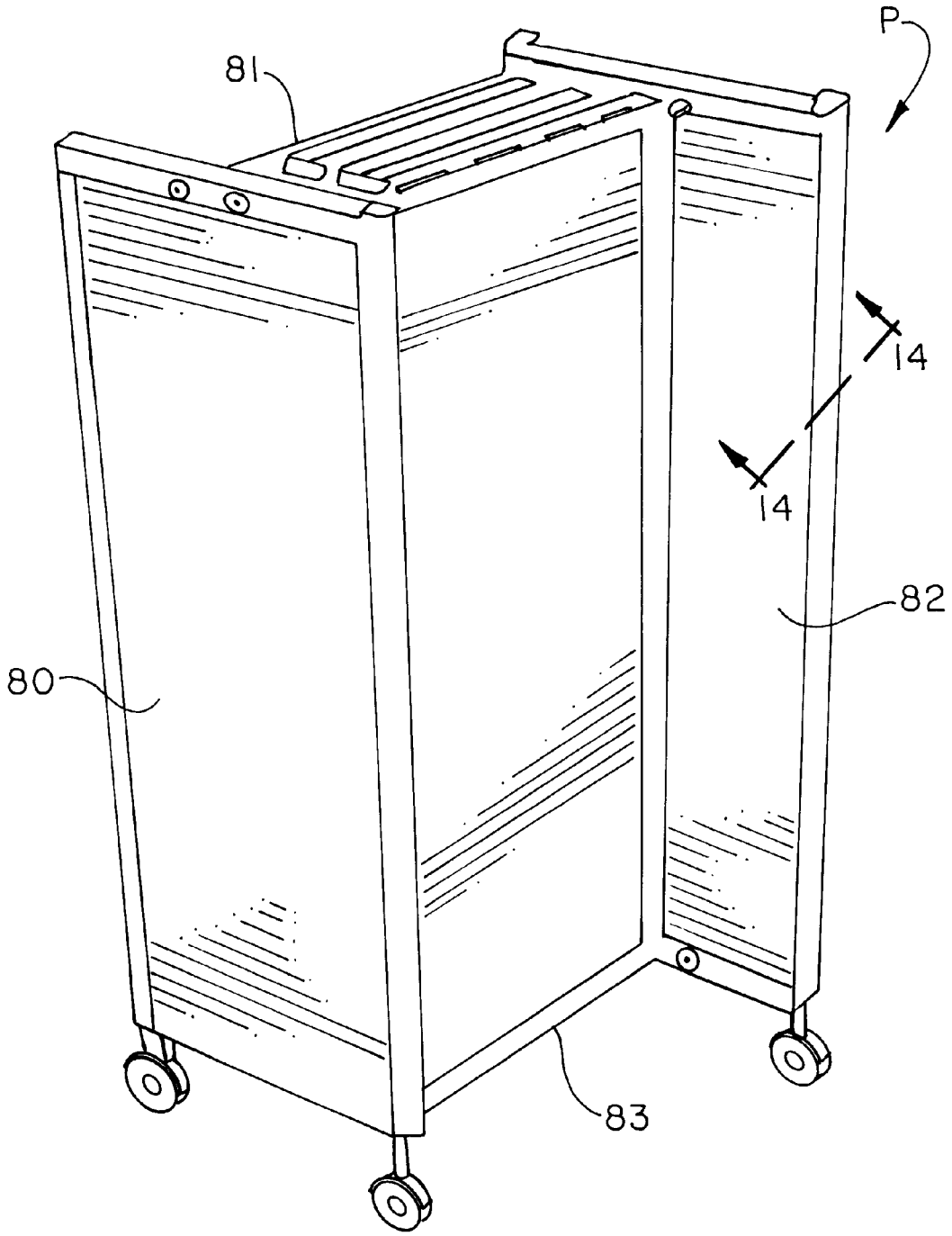
FIG. 12 is a perspective view of a second embodiment of the portable wall partition of the present invention.

Referring to FIG. 11, another embodiment of the pinchless hinge 60 is shown. Hinge 60 includes coupler 61 each with a semicircular portion 63 with meshing teeth 65. Pivot pins 67 go through the axis of the semicircular portions 63. This construction does not have slots as the previous embodiments. Rather first link 69 and second link 71 are placed on top and below the couplers 61 and are captured by pivot pin 67. This construction may offer the same pinchless construction without the need for machining or otherwise creating of slots.

Referring to FIGS. 12–17, a second embodiment of the portable wall partition of the present invention is shown.

The second embodiment is the same as the first embodiment, with the addition of a first full panel end member 80 and second full panel end member 82, each attached substantially perpendicular to one of the plurality of panels at the first end and second end of the extended portable wall partition P. The first full panel end member attaches to the first panel 81 and the second full panel end member attaches to the second panel 83.

Figure 13:
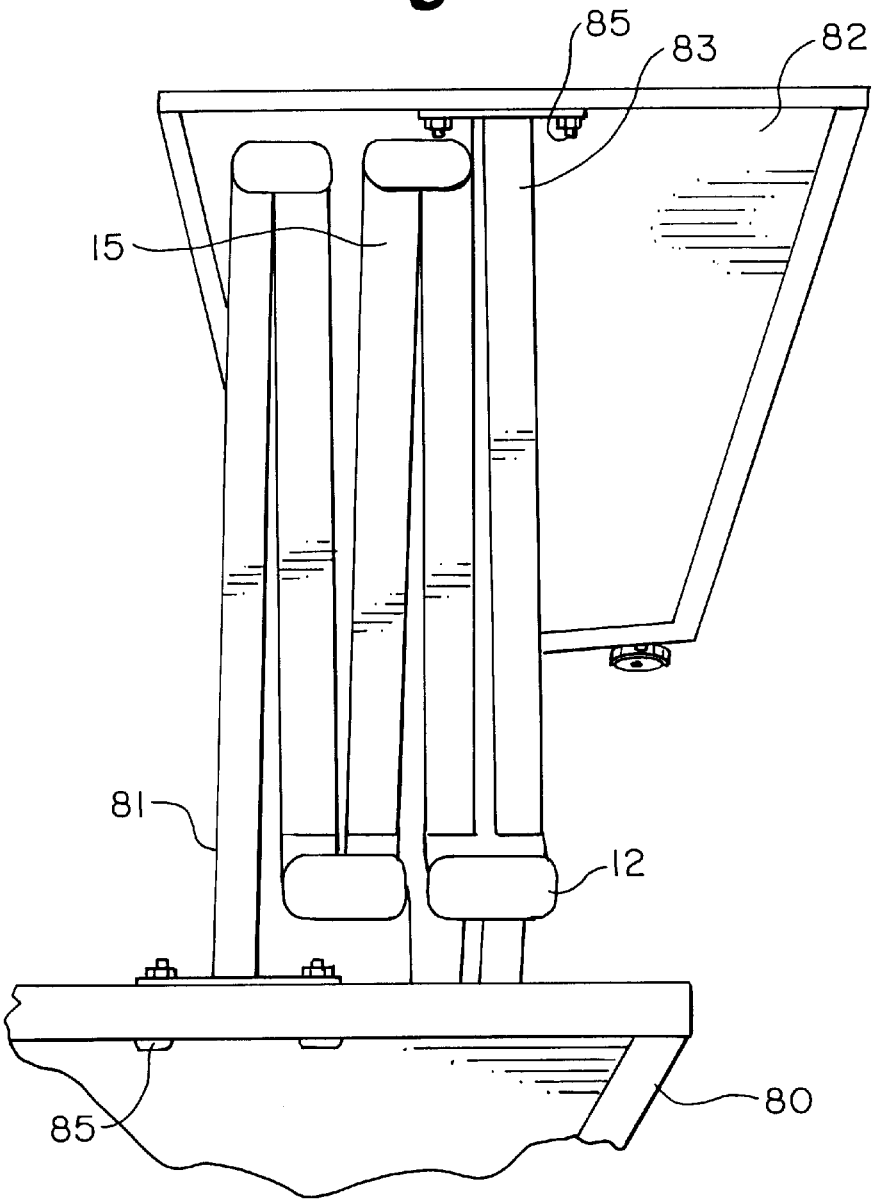
FIG. 13 is a top perspective view of the second embodiment of FIG. 12.

The first and second full panel end members may attach to the first panel and second panel, respectively, by any appropriate method, as by welding or by being bolted by bolts 85, as shown in FIG. 13.

Figure 14:
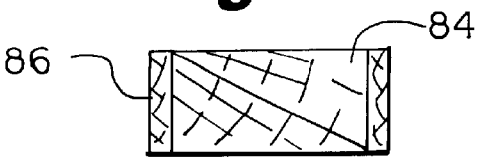
FIG. 14 is a cross-section taken along the lines 14—14 of FIG. 12.

Each of the first full panel end member 80 and second full panel end member 82 is of similar construction to the plurality of panels 15, having a solid core 84 and a fabric 86 covering the solid core 84, as shown in FIG. 14. It will be appreciated that such a construction provides support and rigidity to the portable wall partition P as well as privacy and noise reduction. The solid core can be any stiff, rigid material such as wood, metal, plastic, cardboard or fiberglass.

Preferably, as shown in FIG. 13, the first full panel end member 80 and second full panel end member 82 are attached to the first panel 81 and second panel 83, respectively, at approximately the midpoint of the width of the first full panel end member and second full panel end member.

It will be appreciated that the full panel end members attached substantially perpendicularly to the first panel and second panel prevent the portable wall partition P from tipping while in the extended configuration.

Figure 15:
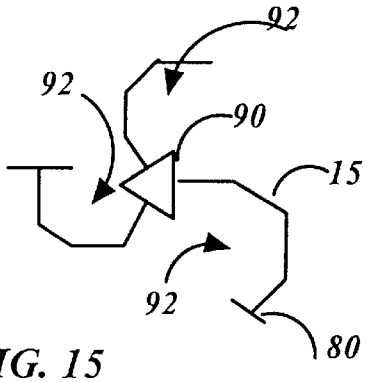
FIG. 15 is a top plan schematic view of three portable wall partitions joined together to form three work areas.

Paying particular attention to FIG. 15, it will be seen that several portable wall partitions P may be arranged in such a way that the second full panel end members 82 are juxtaposed, forming a central polyhedron 90, with each of the portable wall partitions P forming enclosed areas 92 about the central polyhedron 90. In FIG. 15, three portable wall partitions P are shown with the second full panel end members forming a triangle. However, it will be clear that, depending on the number of second full panel end members juxtaposed, other polyhedra such as squares, pentagons, etc. may be formed.

Figure 16:
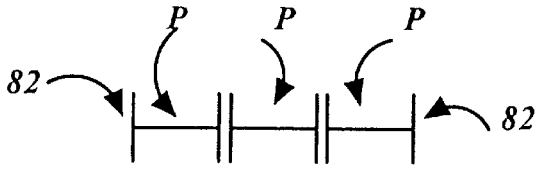
FIG. 16 is a top plan schematic view of three portable wall partitions placed together end-to-end to form a continuous wall.

Turning to FIG. 16, it will be seen that several portable wall partitions P may be juxtaposed end-to-end to form an extended wall with end walls 82 which absorb sound.

Figure 17:
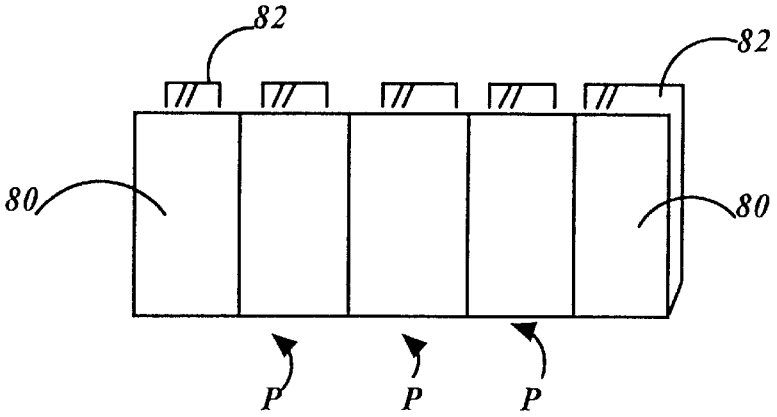
FIG. 17 is a perspective schematic view of five portable wall partitions stored side-by-side in a folded configuration.

FIG. 17 shows that several portable wall partitions P may be stored side by side so that the end walls 80 hide the remainder of the portable wall partitions from view.

The present invention may be embodied in other specific forms without departing from the spirit or essential attributes thereof, and it is therefore desired that the present embodiment be considered in all respects as illustrative and not restrictive, reference being made to the appended claims rather than to the foregoing description to indicate the scope of the invention.

What is claimed:

1. A portable wall partition having a number of panels connected by three point pivoting 360° articulable pinchless hinges which may pivot 360° with respect to each other, and including a pair of full panel end members providing support and rigidity to the portable wall partition as well as privacy and noise reduction, the portable wall partition comprising:

(a) a plurality of panels, each panel further comprising a solid core and a fabric covering the solid core;

(b) a plurality of three point pivoting 360° articulable pinchless hinges connecting each of the plurality of panels to another of the plurality of panels, thereby allowing the plurality of panels to be pivoted between a folded configuration and an extended configuration, wherein in the extended configuration the plurality of panels form an elongate partition having a first end and a second end; and (c) a first full panel end member attached substantially perpendicular to a first panel at the first end and a second full panel end member attached substantially perpendicular to a second panel at the second end, each of the first full panel end member and second full panel end member having a solid core and a fabric covering the solid core.

2. The wall portable partition of claim 1, each hinge further comprising two opposing couplers, each coupler having a toothed, semicircular portion meshed with the opposing coupler toothed semicircular portion and each coupler adapted to be connected to one panel; a pin in each coupler extending along an axis of the semicircular portion; and a link connecting each pin to maintain the meshed engagement of the couplers through 360° of coupler pivotal rotation with respect to each other, the link having a width substantially that of the width of the coupler and adapted to block and prevent the meshed semicircular portions from pinching a person's fingers.

3. The portable wall partition of claim 1, wherein the panels are separated by a gap and further comprising opposing semicircular sponge-like portions closing the gap between the panels.

4. The portable wall partition of claim 2, further comprising a slot in each coupler extending transversely of the axis and through the semicircular portions wherein the link is within the slot.

5. The portable wall partition of claim 4, further comprising a second link connecting each pin.

6. The portable wall partition of claim 2 wherein the pin is fit within an aperture along and through the axis.

7. The portable wall partition of claim 2, further comprising a second link connecting each pin.

8. The portable wall partition of claim 2, further comprising two slots in each coupler extending transversely of the axis and through the semicircular portions wherein the first link is within the slot and a second link connecting each pin is in the second slot.

9. The portable wall partition of claim 1, further comprising a plurality of ground-contacting wheels supporting selected ones of the plurality of panels and the first full panel end member and second full panel end member.

10. A portable wall partition having a number of panels connected by three point pivoting 360° articulable pinchless hinges which may pivot 360° with respect to each other, and including a pair of full panel end members providing support and rigidity to the portable wall partition as well as privacy and noise reduction, the portable wall partition comprising:

(a) a plurality of panels, each panel further comprising a solid core and a fabric covering the solid core, each panel having a height and a width, (b) a plurality of hinges connecting each of the plurality of panels to another of the plurality of panels, thereby allowing the plurality of panels to be pivoted between a folded configuration and an extended configuration, wherein in the extended configuration the plurality of panels form an elongate partition having a first end and a second end; and (c) a first full panel end member attached substantially perpendicular to a first panel at the first end at approximately the mid-point of the first full panel end member width and a second full panel end member attached substantially perpendicular to a second panel at the second end at approximately the mid-point of the second full panel end member width, each of the first full panel end member and second full panel end member having a solid core and a fabric covering the solid core.

11. The wall portable partition of claim 10, each hinge further comprising two opposing couplers, each coupler having a toothed, semicircular portion meshed with the opposing coupler toothed semicircular portion and each coupler adapted to be connected to one panel; a pin in each coupler extending along an axis of the semicircular portion; and a link connecting each pin to maintain the meshed engagement of the couplers through 360° of coupler pivotal rotation with respect to each other, the link having a width substantially that of the width of the coupler and adapted to block and prevent the meshed semicircular portions from pinching a person's fingers.

12. The portable wall partition of claim 10, wherein the panels are separated by a gap and further comprising opposing semicircular sponge-like portions closing the gap between the panels.

13. The portable wall partition of claim 11, further comprising a slot in each coupler extending transversely of the axis and through the semicircular portions wherein the link is within the slot.

14. The portable wall partition of claim 11, further comprising a second link connecting each pin.

15. The portable wall partition of claim 11 wherein the pin is fit within an aperture along and through the axis.

16. The portable wall partition of claim 11, further comprising a second link connecting each pin.

17. The portable wall partition of claim 11, further comprising two slots in each coupler extending transversely of the axis and through the semicircular portions wherein the first link is within the slot and a second link connecting each pin is in the second slot.

18. The portable wall partition of claim 10, further comprising a plurality of ground-contacting wheels supporting selected ones of the plurality of panels and the first full panel end member and second full panel end member.

19. A portable wall partition having a number of panels connected by three point pivoting 360° articulable pinchless hinges which may pivot 360° with respect to each other, and including a pair of full panel end members providing support and rigidity to the portable wall partition as well as privacy and noise reduction, the portable wall partition comprising:

(a) a plurality of panels, each panel further comprising a solid core and a fabric covering the solid core, each panel having a height and a width, (b) a plurality of hinges connecting each of the plurality of panels to another of the plurality of panels, thereby allowing the plurality of panels to be pivoted between a folded configuration and an extended configuration, wherein in the extended configuration the plurality of panels form an elongate partition having a first end and a second end, each hinge further comprising two opposing couplers, each coupler having a toothed, semicircular portion meshed with the opposing coupler toothed semicircular portion and each coupler adapted to be connected to one panel; a pin in each coupler extending along an axis of the semicircular portion; and a link connecting each pin to maintain the meshed engagement of the couplers through 360° of coupler pivotal rotation with respect to each other, the link having a width substantially that of the width of the coupler and adapted to block and prevent the meshed semicircular portions from pinching a person's fingers; and (c) a first full panel end member attached substantially perpendicular to a first panel at the first end at approximately the mid-point of the first full panel end member width and a second full panel end member attached substantially perpendicular to a second panel at the second end at approximately the mid-point of the second full panel end member width, each of the first full panel end member and second full panel end member having a solid core and a fabric covering the solid core.

20. The portable wall partition of claim 19, wherein the panels are separated by a gap and further comprising opposing semicircular sponge-like portions closing the gap between the panels.

21. The portable wall partition of claim 10, further comprising a plurality of ground-contacting wheels supporting selected ones of the plurality of panels and the first full panel end member and second full panel end member.

* * * * *